US009737998B2

(12) United States Patent
Clemens

(10) Patent No.: US 9,737,998 B2
(45) Date of Patent: Aug. 22, 2017

(54) MULTI-CUTTER KNIFE

(71) Applicant: Bradley Clemens, Alamogordo, NM (US)

(72) Inventor: Bradley Clemens, Alamogordo, NM (US)

(73) Assignee: Bradley Alan Clemens, La Luz, NM (US)

( * ) Notice: Subject to any disclaimer, the term of this patent is extended or adjusted under 35 U.S.C. 154(b) by 0 days.

(21) Appl. No.: 14/845,284

(22) Filed: Sep. 4, 2015

(65) Prior Publication Data

US 2017/0066146 A1 Mar. 9, 2017

(51) Int. Cl.
*B26B 5/00* (2006.01)

(52) U.S. Cl.
CPC ..... *B26B 5/008* (2013.01); *B26B 5/00* (2013.01)

(58) Field of Classification Search
CPC ..... B26B 5/008; B26B 3/04; B26B 5/00
See application file for complete search history.

(56) References Cited

U.S. PATENT DOCUMENTS 608,337 A * 8/1898 Merkle ..... B26B 3/04 30/304
639,850 A * 12/1899 Hahn ..... B26B 3/04 30/304
1,205,871 A * 11/1916 Dwyer ..... B26B 3/04 30/304
1,342,383 A * 6/1920 Horvath ..... B26B 3/04 30/304
1,530,796 A * 3/1925 Thomsen ..... A21C 5/00 30/304
4,085,504 A * 4/1978 Nagy ..... B26B 5/008 30/123

* cited by examiner

*Primary Examiner* — Daniel J Colilla

(57) ABSTRACT

The present invention discloses a new product that saves time while maintaining consistency in the sizes of the portions the user is cutting. The present invention provides a fast and efficient way to cut foods, like jelly, brownies, corn bread and sheet cake into uniformly-sized portions by being able to cut a whole sheet of product with just two cuts, one vertically and one horizontally across the pan. The portions will be of equal sizes and with neat straight lines and hence eliminates the wasting of ingredients and product by not being able to serve inconsistent portions and those which are not cut neatly. The chow lines will move much faster when perfectly-sized portions is cut and served quickly.

6 Claims, 7 Drawing Sheets

MULTI-CUTTER KNIFE

FIELD OF THE INVENTION

The present invention relates generally to a device that is a tool to be used for making perfectly straight lines while saving time when cutting sheets of foods, like brownies, jelly, cornbread, and sheet cakes. It will also ensure that the portions are equal, so customers will be happy, and no product is wasted because the pieces are too small or have a messy appearance.

BACKGROUND OF THE INVENTION

When working in the food service industry, controlling costs while maintaining quality is extremely important. When serving food products that are prepared on baking sheets, like cornbread, jelly, brownies and sheet cakes, individual portions that are cut and served should all be the same size and look presentable. This is hard to accomplish when using a knife to cut each piece, and the speed for serving these foods is decreased enormously by having to cut each piece separately, which is undesirable.

SUMMARY OF THE INVENTION

The present invention discloses a new multi-cutter knife that saves time while maintaining consistency in the sizes of the portions, which the user is cutting. The present invention provides a fast and efficient way to cut foods, like jelly, brownies, corn bread and sheet cake into uniformly-sized portions by being able to cut a whole sheet of product with just two cuts, one vertically and one horizontally across the pan. The portions will be of equal sizes and with neat straight lines and hence eliminates the wasting of ingredients and product by not being able to serve inconsistent portions and those which are not cut neatly. The chow lines will move much faster when perfectly-sized portions is cut and served quickly. Moreover, the present invention discloses a new multi-cutter knife wherein the at-least one knife is removable.

DETAIL DESCRIPTION OF THE INVENTION

All illustrations of the drawings are for the purpose of describing selected versions of the present invention and are not intended to limit the scope of the present invention.

Figure 1:
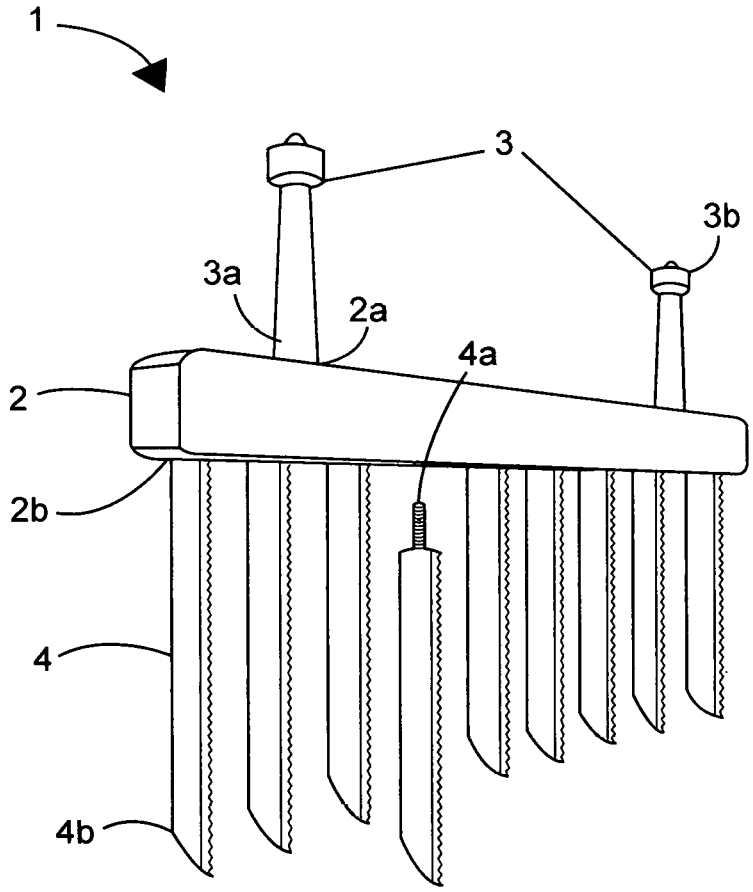
FIG. 1 is an isometric view of the multi-cutter 1.

FIG. 1 represents the present invention which discloses a multi-cutter 1 wherein the multi-cutter 1 comprises a base 2, a handle 3, and at least two cutting knifes 4. The multi-cutter 1 is designed to make it easier and faster to cut and serve food items, like brownies, jelly, corn bread and sheet cake. A first end 3*a* of a handle 3 is coupled to a first side 2*a* of the base 2 and a second end 3*b* of the handle 3 enables the user to hold on it. Moreover, a first end 4*a* of the each knife 4 is coupled to a second side 2*b* of the base 2 and the second end 4*b* of the each knife 4 is enabled to cut the food items.

However, it is within the scope of the invention that the each knife 4 is enabled to be removed from the base 2 of the multi-cutter 1. Also, the knives 4 can be of different shape or size or are present to solve a different purpose. Moreover, first end 3*a* at least one handle 3 is attached to the first side 2*a* of the base 2 of the multi-cutter 1.

In one example of the present invention, the base consists of several cutting knives 4 attached to the second side 2*b* of the base 2. The user grasps the second end 3*b* of the handles 3 and slides the cutting knives 4 across the pan in one direction, cutting uniformly-sized rows. The pan is then turned, and the user cuts across the rows to create perfectly-sized portions quickly and easily. It is within the scope of the invention that the multi-cutter 1 can be of different sizes for use on different-sized pans.

Figure 2:
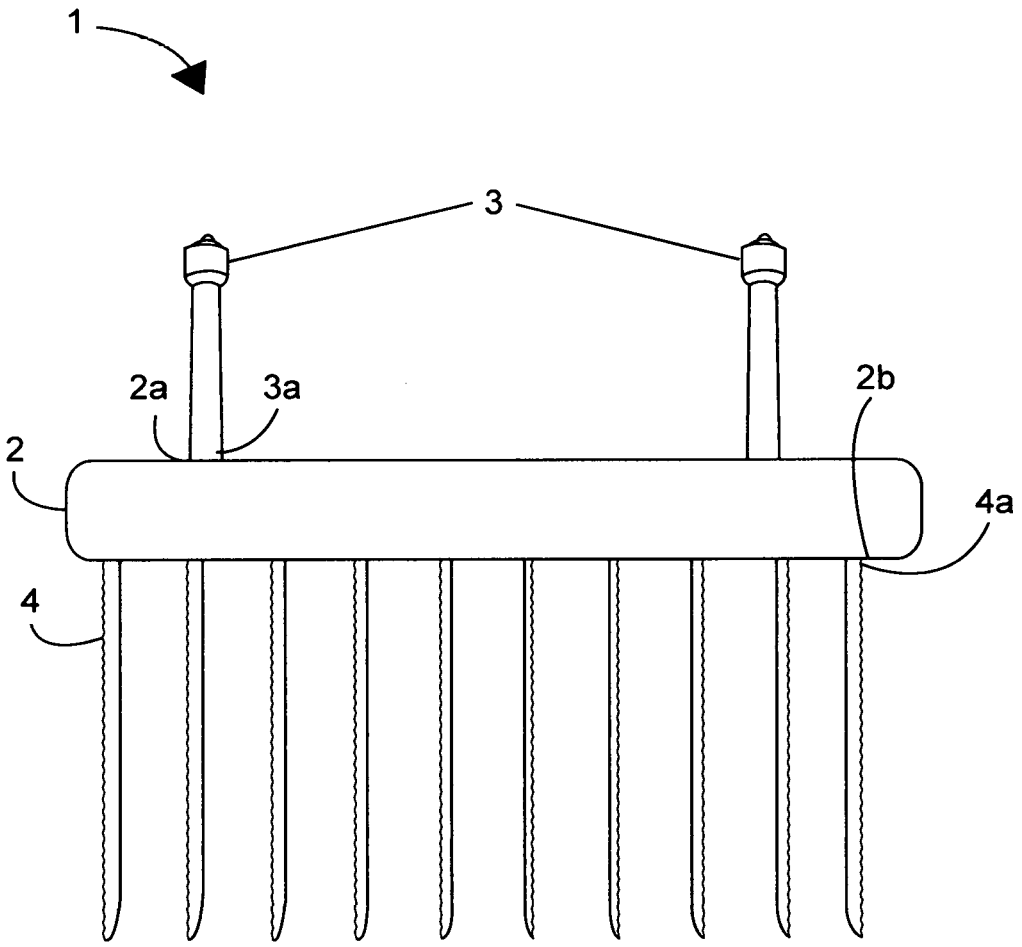
FIG. 2 is a front view of the multi-cutter 1.

FIG. 2 represents the side view of the multi-cutter 1 wherein the first end 4*a* of the knife 4 is coupled to the second side 2*b* of the base 2 of the multi-cutter 1. Moreover, first end 4*a* at least one handle 4 is coupled to the first side 2*a* of the base 2 of the multi-cutter 1.

Figure 3:
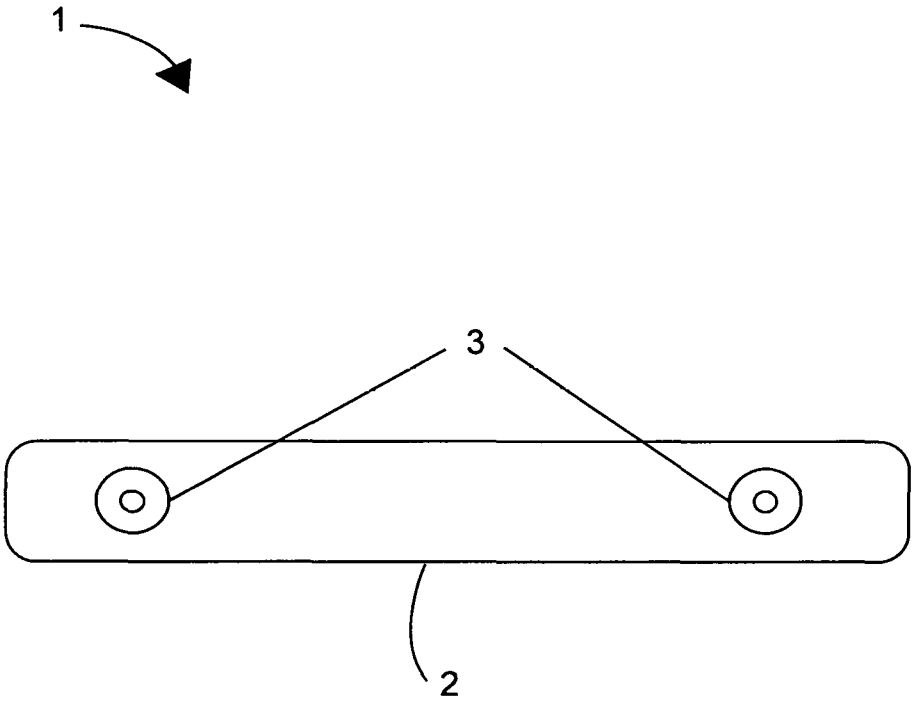
FIG. 3 is a top view of the multi-cutter 1.

FIG. 3 represents the top view of the multi-cutter 1 wherein the handle 4 is coupled to the first side 2*a* of the base 2 of the multi-cuter 1.

Figure 4:
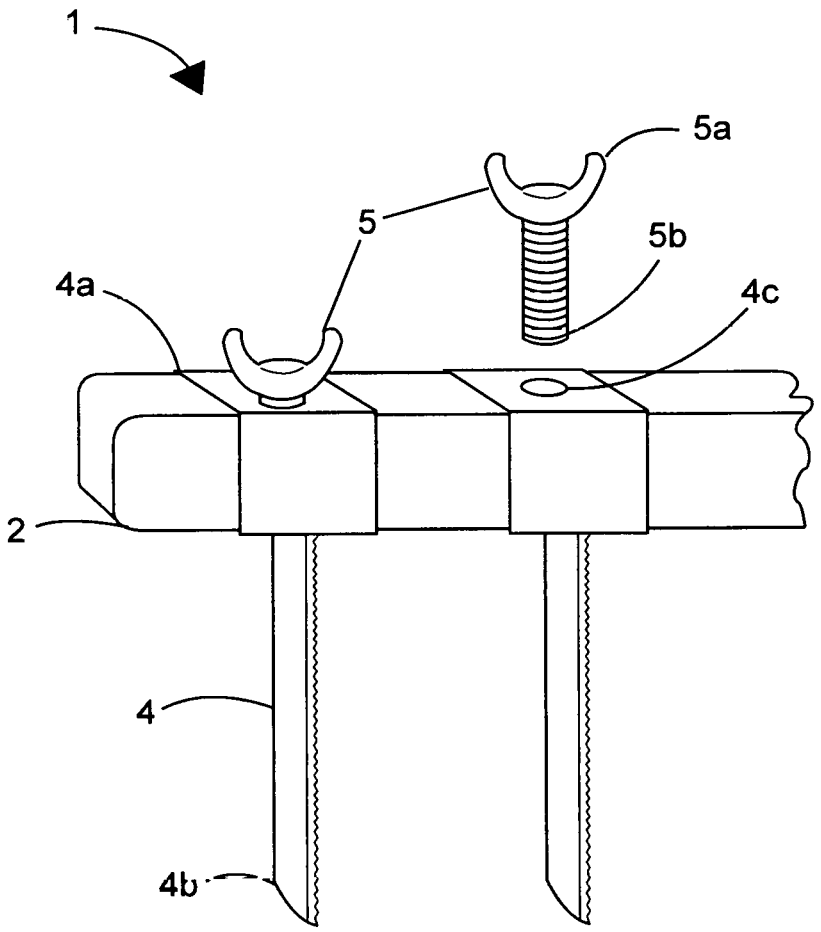
FIG. 4 illustrates a coupling wing 5 which is used to couple the knife 4 with the base 2 of the multi-cutter 1.

FIG. 4 illustrates a coupling wing 5 which is used to couple the knife 4 with the base 2 of the multi-cutter 1. First end 4*a* of the knife 4 is enabled to couple to the base 2 of the multi-cutter 1 wherein the wing 5 is provided to couple the first end 4*a* of the knife 4 with the base 2. Wing 5 is a screw-threaded and its second end 5*b* is enabled to couple with the opening 4*c* of first end 4*a* of knife 4. User actuates the first end 5*a* of the wing 5 to couple the knife 4 with the base 2.

Figure 5A:
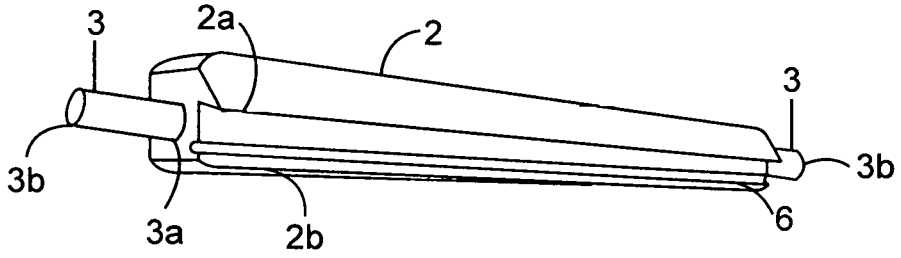
FIG. 5*a* illustrates a base of the multi-cutter 1 wherein the base 2 comprises grooves 2*b* and wedge shape coupling means 2*a*.

FIG. 5*a* illustrates a base of the multi-cutter 1 wherein the base 2 comprises grooves 6 and wedge shape coupling means 2*a*. Handle 3 are connected on the base 2 wherein the first end 3*a* of the handle 3 is coupled with the base 2 and second end 3*b* of the handle 3 is made available for the user to hold it. Wedge shape coupling means 2*a* is provided on the base 2 so as to provide better gripping to the knife 4. Moreover, grooves 6 are provided on the base 2 so as to provide better and stable gripping to the knife 4.

Figure 5B:
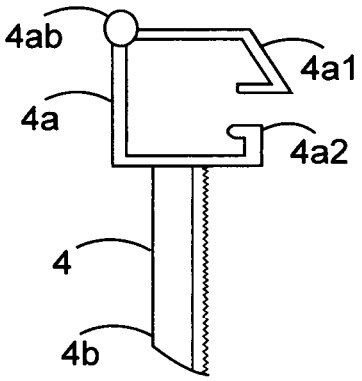
FIG. 5*b* illustrates a side view of the knife 4.

FIG. 5*b* is a side view of the knife 4. The first end 4*a* of the knife 4 comprises a hook coupling 4*a*1 to couple with the wedge shape coupling means 2*a* of the base 2. The first end 4*a* of the knife 4 further comprises a protrusion 4*a*2 to couple with the groove 6 of the base 2. The first end 4*a* further comprises a pivot 4*ab* to enable the user to couple the knife 4 with the base 2.

Figure 5C:
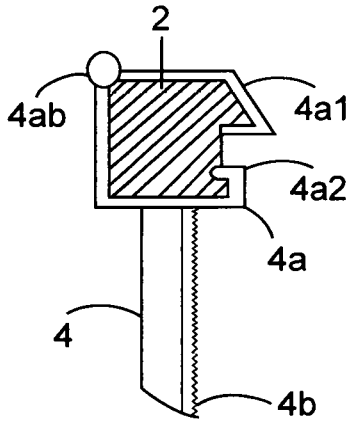
FIG. 5*c* illustrates a side view of the knife 4 coupled with the base 2 of the multi-cutter 1.

FIG. 5*c* is a side view of the knife 4 coupled with the base 2 of the multi-cutter 1. The hook coupling 4*a*1 is coupled with the wedge shape coupling of the base 2 and a protrusion 4*a*2 is coupled with the groove 6 of the base 2.

Figure 5D:
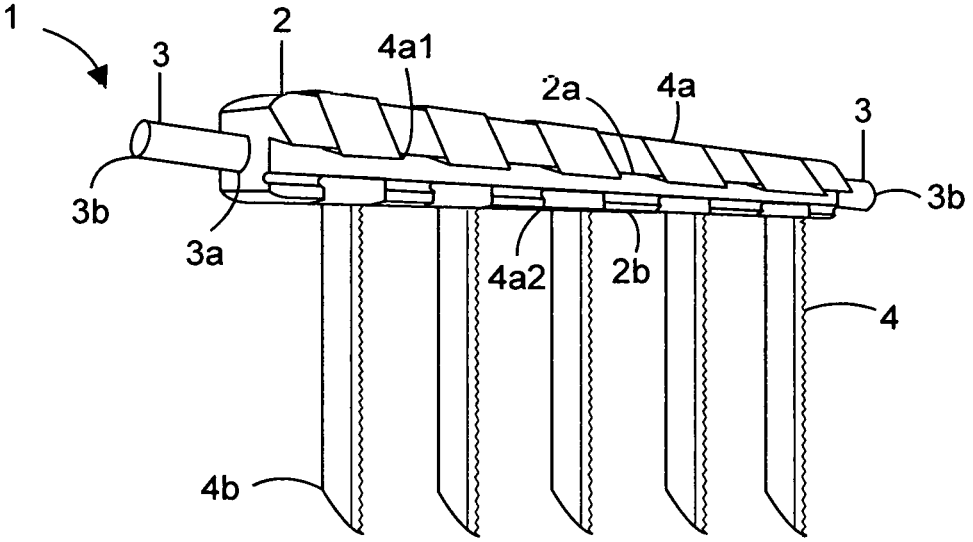
FIG. 5*d* illustrates an isometric view of the multi-cutter 1 having knives 4 coupled with the base 2.

FIG. 5*d* is an isometric view of the multi-cutter 1 with the multiple knives 4 coupled with the base 2.

Figure 6A:
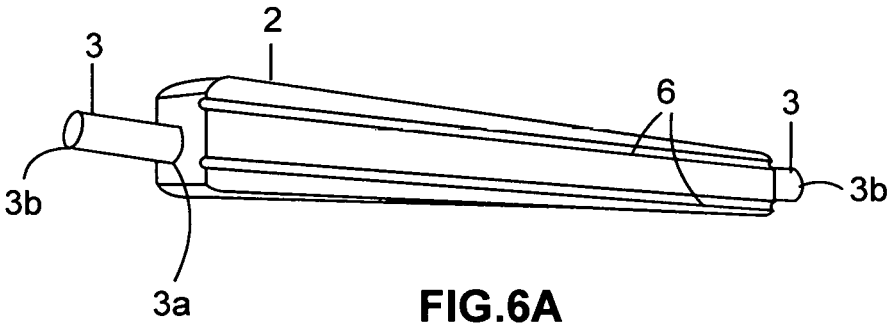
FIG. 6*a* illustrates a base 2 of the multi-cutter 1 wherein the base 2 comprises multiple grooves 6.

FIG. 6*a* illustrates a base of the multi-cutter 1 wherein the base 2 comprises multiple rows of grooves 2*b*. Handle 3 are connected on the base 2 wherein the first end 3*a* of the handle 3 is coupled with the base 2 and second end 3*b* of the handle 3 is made available for the user to hold it. Multiple rows of grooves 6 are provided on the base 2 so as to provide better and stable gripping to the knife 4.

Figure 6B:
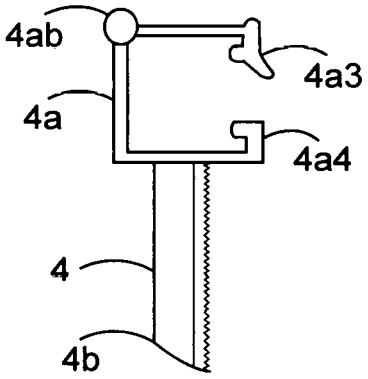
FIG. 6*b* illustrates a side view of the knife 4.

FIG. 6*b* is a side view of the knife 4. The first end 4*a* of the knife 4 comprises a first protrusion 4*a*3 and second protrusion 4*a*4 wherein the first protrusion 4*a*3 and second protrusion 4*a*4 is enabled to couple with the groove 6 of the base 2. The first end 4*a* further comprises a pivot 4*ab* to enable the user to couple the knife 4 with the base 2.

Figure 6C:
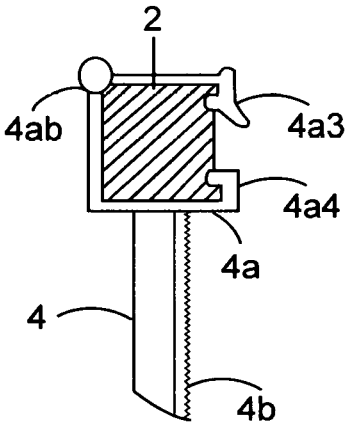
FIG. 6*c* illustrates a side view of the knife 4 coupled with the base 2 of the multi-cutter 1.

FIG. 6*c* is a side view of the knife 4 coupled with the base 2 of the multi-cutter 1. The first protrusion 4*a*3 and second protrusion 4*a*4 is coupled with the groove 6 of the base 2.

Figure 6D:
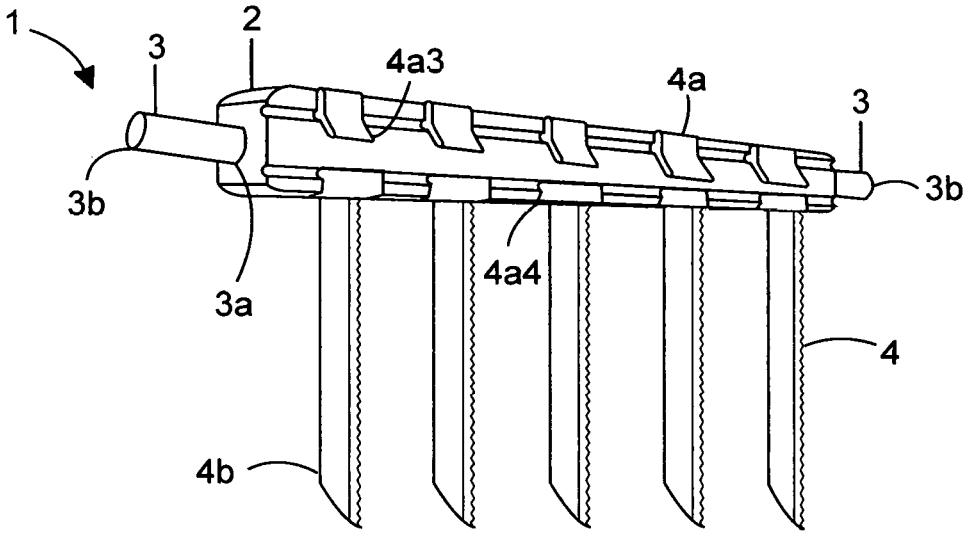
FIG. 6*d* illustrates an isometric view of the multi-cutter 1 having knives 4 coupled with the base 2.

FIG. 6*d* is an isometric view of the multi-cutter 1 with the multiple knives 4 coupled with the base 2.

Figure 7A:
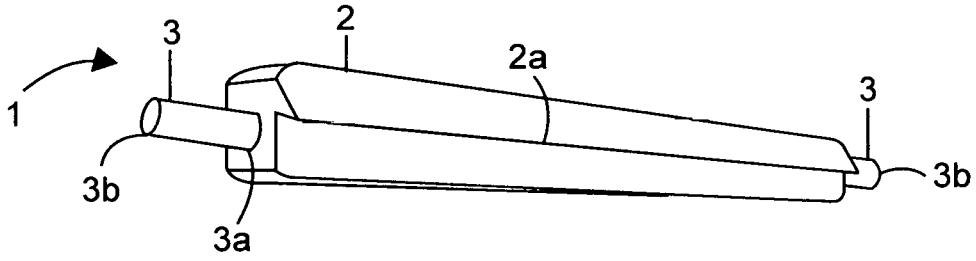
FIG. 7*a* illustrates a base of the multi-cutter 1 wherein the base 2 is having wedge shape coupling means 2*a*.

FIG. 7*a* illustrates a base of the multi-cutter 1 wherein the base 2 a wedge shape coupling means 2*a*. Handle 3 are connected on the base 2 wherein the first end 3*a* of the handle 3 is coupled with the base 2 and second end 3*b* of the handle 3 is made available for the user to hold it. Wedge shape coupling means 2*a* is provided on the base 2 so as to provide better and stable gripping to the knife 4.

Figure 7B:
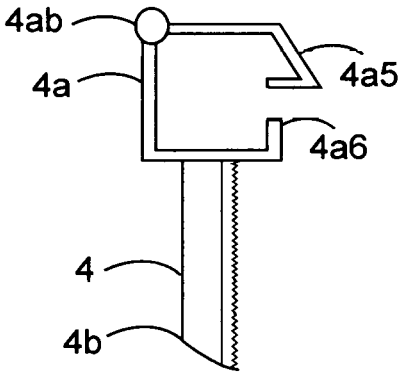
FIG. 7*b* illustrates a side view of the knife 4.

FIG. 7*b* is a side view of the knife 4. The first end 4*a* of the knife 4 comprises a hook element 4*a*5 and a holding element 4*a*6 wherein the hook element 4*a*5 is enabled to couple with the wedge shape 2*a* of the base 2. The first end 4*a* further comprises a pivot 4*ab* to enable the user to couple the knife 4 with the base 2.

Figure 7C:
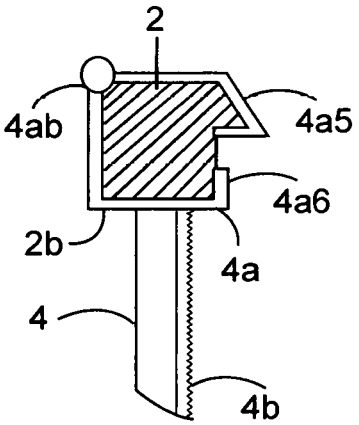
FIG. 7*c* illustrates a side view of the knife 4 coupled with the base 2 of the multi-cutter 1.

FIG. 7*c* is a side view of the knife 4 coupled with the base 2 of the multi-cutter 1. The hook element 4*a*5 is coupled with the wedge shape 2*a* of the base 2 and holding element 4*a*6 coupled to the side 2*b* of the base 2.

Figure 7D:
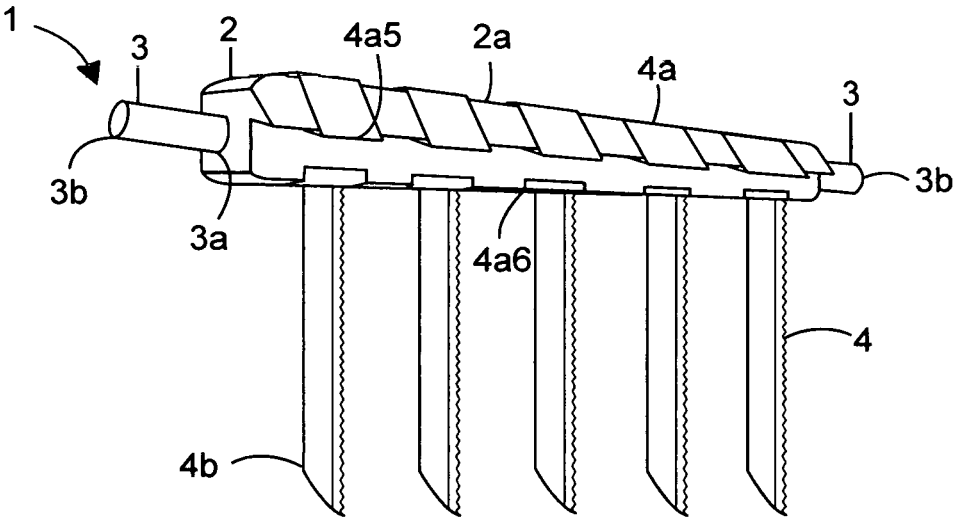
FIG. 7*d* illustrates an isometric view of the multi-cutter 1 having knives 4 coupled with the base 2.

FIG. 7*d* is an isometric view of the multi-cutter 1 with the multiple knives 4 coupled with the base 2.

Although the invention has been explained in relation to its preferred embodiment, it is to be understood that many other possible modifications and variations can be made without departing from the spirit and scope of the invention.

What is claimed is:

1. A multi-cutter comprising:

a base having a wedge-shaped coupling means on its surface, wherein the wedge-shaped coupling means is enabled to hold a knife on the base, at least two knives wherein each knife comprises a first end and a hook coupling including a hook element and a holding element, wherein each hook element is coupled to the wedge-shaped coupling means of the base and each holding element is coupled to a side of the base, wherein the knife further comprises a pivot coupled between the first end and the hook coupling for enabling the user to couple the knife with the base.

2. The multi-cutter in claim 1; wherein each knife is removably coupled to the multi-cutter by decoupling the hook element and the holding element of the corresponding knife from the base.

3. The multi-cutter in claim 1; wherein each knife is integrally coupled to the multi-cutter by the hook element and the holding element of the corresponding knife from the base.

4. The multi-cutter in claim 1; wherein the base is enabling to support multiple number of knifes depending upon a user need and choice.

5. The multi-cutter in claim 1; wherein the base further comprises a handle, wherein a first end of the handle is coupled with the base and a second end of the handle is made available for a user to hold it.

6. The multi-cutter in claim 1; wherein the wedge shape coupling means is provided on the base to provide better and stable gripping of each knife.

* * * * *